US009334710B2

(12) United States Patent
Pacey et al.

(10) Patent No.: US 9,334,710 B2
(45) Date of Patent: May 10, 2016

(54) INTERRUPTIBLE PRESSURE TESTING VALVE

(71) Applicant: Halliburton Energy Services, Inc., Houston, TX (US)

(72) Inventors: Kendall Lee Pacey, Duncan, OK (US); Kevin Thomas Berscheidt, Marlow, OK (US); Matthew Todd Howell, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 442 days.

(21) Appl. No.: 13/742,869

(22) Filed: Jan. 16, 2013

(65) Prior Publication Data

US 2014/0196892 A1 Jul. 17, 2014

(51) Int. Cl.

| | |
|---|---|
| ***E21B 34/12*** | (2006.01) |
| ***E21B 34/10*** | (2006.01) |
| ***E21B 34/06*** | (2006.01) |
| ***E21B 47/10*** | (2012.01) |

(52) U.S. Cl.

CPC ..... *E21B 34/103* (2013.01); *E21B 34/063* (2013.01); *E21B 47/1025* (2013.01)

(58) Field of Classification Search

CPC ... E21B 34/102; E21B 34/103; E21B 34/125; E21B 34/12

USPC ..... 166/334.1, 334.4

See application file for complete search history.

(56) References Cited

U.S. PATENT DOCUMENTS

| | | | | |
|---|---|---|---|---|
| 4,324,293 | A * | 4/1982 | Hushbeck | 166/317 |
| 5,207,274 | A | 5/1993 | Streich et al. | |
| 5,224,540 | A | 7/1993 | Streich et al. | |
| 5,271,468 | A | 12/1993 | Streich et al. | |
| 5,343,954 | A | 9/1994 | Bohlen et al. | |
| 5,390,737 | A | 2/1995 | Jacobi et al. | |

(Continued)

FOREIGN PATENT DOCUMENTS

| | | | |
|---|---|---|---|
| WO | 02/075104 | A1 | 9/2002 |
| WO | 2012037646 | A1 | 3/2012 |

(Continued)

OTHER PUBLICATIONS

International Search Report issued in related PCT Application No. PCT/US2014/011114 mailed Oct. 30, 2014, 4 pages.

(Continued)

*Primary Examiner* — Kenneth L Thompson

(74) *Attorney, Agent, or Firm* — John W. Wustenberg; Baker Botts L.L.P.

(57) ABSTRACT

A wellbore servicing system comprising a pressure testing valve incorporated within a casing string and comprising a housing comprising one or more ports and an axial flowbore, a sliding sleeve, wherein the sliding sleeve is positioned within the housing and transitional from a first position to a second position through a sliding sleeve stroke, wherein, in the first position, the sliding sleeve blocks a route of fluid communication via the one or more ports and, in the second position the sliding sleeve does not block the route of fluid communication via the one or more ports, wherein the pressure testing valve is configured such that application of a predetermined pressure to the axial flowbore for a predetermined duration causes the sliding sleeve to transition from the first position to the second position, wherein the predetermined duration is at least about one minute.

15 Claims, 4 Drawing Sheets

(56) References Cited

U.S. PATENT DOCUMENTS

| | | | | |
|---|---|---|---|---|
| 5,540,279 | A | 7/1996 | Branch et al. | |
| 5,669,448 | A | 9/1997 | Minthorn et al. | |
| 5,839,515 | A | 11/1998 | Yuan et al. | |
| 5,865,254 | A * | 2/1999 | Huber et al. | 166/373 |
| 5,984,007 | A | 11/1999 | Yuan et al. | |
| 6,220,349 | B1 | 4/2001 | Vargus et al. | |
| 6,394,180 | B1 | 5/2002 | Berscheidt et al. | |
| 6,491,116 | B2 | 12/2002 | Berscheidt et al. | |
| 6,666,275 | B2 | 12/2003 | Neal et al. | |
| 7,195,067 | B2 | 3/2007 | Manke et al. | |
| 7,255,162 | B2 | 8/2007 | Stevens et al. | |
| 7,337,852 | B2 | 3/2008 | Manke et al. | |
| 7,510,017 | B2 | 3/2009 | Howell et al. | |
| 7,559,363 | B2 | 7/2009 | Howell et al. | |
| 7,617,871 | B2 | 11/2009 | Surjaatmadja et al. | |
| 7,673,673 | B2 | 3/2010 | Surjaatmadja et al. | |
| 7,878,255 | B2 | 2/2011 | Howell et al. | |
| 7,946,340 | B2 | 5/2011 | Surjaatmadja et al. | |
| 7,963,331 | B2 | 6/2011 | Surjaatmadja et al. | |
| 8,056,638 | B2 | 11/2011 | Clayton et al. | |
| 8,146,673 | B2 | 4/2012 | Howell et al. | |
| 8,276,675 | B2 * | 10/2012 | Williamson et al. | 166/383 |
| 8,322,449 | B2 | 12/2012 | Clayton et al. | |
| 8,668,012 | B2 * | 3/2014 | Porter et al. | 166/318 |
| 8,757,273 | B2 * | 6/2014 | Themig et al. | 166/373 |
| 8,931,565 | B2 * | 1/2015 | Desranleau et al. | 166/373 |
| 2007/0084605 | A1 | 4/2007 | Walker et al. | |
| 2008/0135248 | A1 | 6/2008 | Talley et al. | |
| 2008/0202764 | A1 | 8/2008 | Clayton et al. | |
| 2009/0308588 | A1 | 12/2009 | Howell et al. | |
| 2011/0253383 | A1 | 10/2011 | Porter et al. | |
| 2012/0205120 | A1 | 8/2012 | Howell | |
| 2012/0205121 | A1 | 8/2012 | Porter et al. | |
| 2014/0060852 | A1 | 3/2014 | Smith et al. | |

FOREIGN PATENT DOCUMENTS

| | | | |
|---|---|---|---|
| WO | 2012107731 | A2 | 8/2012 |
| WO | 2012/164236 | A1 | 12/2012 |

OTHER PUBLICATIONS

International Preliminary Report on Patentability issued in related PCT Application No. PCT/US2014/011114, mailed Jul. 30, 2015 (11 pages).

Examiner's Report issued in related Australian Patent Application No. 2014207777, mailed Dec. 15, 2015 (3 pages).

* cited by examiner

INTERRUPTIBLE PRESSURE TESTING VALVE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

When wellbores are prepared for oil and gas production, it is common to cement a casing string within the wellbore. Often, it may be desirable to cement the casing within the wellbore in multiple, separate stages. Furthermore, stimulation equipment may be incorporated within the casing string for use in the overall production process. The casing and stimulation equipment may be run into the wellbore to a predetermined depth. Various "zones" in the subterranean formation may be isolated via the operation of one or more packers, which may also help to secure the casing string and stimulation equipment in place, and/or via cement.

Following placement of the casing string and stimulation equipment within the wellbore, it may be desirable to "pressure test" the casing string and stimulation equipment, to ensure the integrity of both, for example, to ensure that a hole or leak has not developed during placement of the casing string and stimulation equipment. Pressure-testing generally involves pumping a fluid into an axial flowbore of the casing string such that a pressure is internally applied to the casing string and the stimulation equipment and maintaining that hydraulic pressure for sufficient period of time to ensure the integrity of both, for example, to ensure that a hole or leak has not developed. To accomplish this, no fluid pathway out of the casing string can be open, for example, all ports or windows of the fracturing equipment, as well as any additional routes of fluid communication, must be closed or restricted.

Following the pressure test, it may be desirable to provide at least one route of fluid communication out of the casing string. Conventionally, the methods and/or tools employed to provide fluid pathways out of the casing string after the performance of a pressure test are configured to open upon exceeding the pressure levels achieved during pressure testing, thereby limiting the pressures that may be achieved during that pressure test. Such excessive pressure levels required to open the casing string may jeopardize the structural integrity of the casing string and/or stimulation equipment, for example, by requiring that the casing and/or various other wellbore servicing equipment components be subjected to pressures near or in excess of the pressures for which such casing string and/or wellbore servicing component may be rated. Thus, a need exists for improved pressure testing valves and methods of using the same.

SUMMARY

Disclosed herein is a wellbore servicing system comprising a casing string, and a pressure testing valve, the pressure testing valve incorporated within the casing string and comprising a housing comprising one or more ports and an axial flowbore, a sliding sleeve, wherein the sliding sleeve is slidably positioned within the housing and transitional from a first position to a second position through a sliding sleeve stroke, wherein, when the sliding sleeve is in the first position, the sliding sleeve blocks a route of fluid communication via the one or more ports and, when the sliding sleeve is in the second position the sliding sleeve does not block the route of fluid communication via the one or more ports wherein the pressure testing valve is configured such that application of a predetermined pressure to the axial flowbore for a predetermined duration causes the sliding sleeve to transition from the first position to the second position, wherein the predetermined duration is at least about one minute.

Also disclosed herein is a wellbore servicing method comprising positioning casing string having a pressure testing valve incorporated therein within a wellbore penetrating the subterranean formation, wherein the pressure testing valve comprises a housing comprising one or more ports and an axial flowbore, and a sliding sleeve, wherein the sliding sleeve is slidably positioned within the housing, wherein the sliding sleeve is configured to block a route of fluid communication via one or more ports when the casing string is positioned within the wellbore applying a fluid pressure of at least a pressure threshold to the axial flowbore, wherein, upon application of the fluid pressure of at least the pressure threshold, the sliding sleeve continues to block the route of fluid communication via the one or more ports, and continuing to apply fluid pressure to the axial flowbore for a predetermined duration of time, wherein the predetermined duration is at least about one minute, and wherein, following the predetermined duration of time, the sliding sleeve allows fluid communication via one or more ports of the housing.

Further disclosed herein is a wellbore servicing method comprising positioning a casing string having a pressure testing valve incorporated therein within a wellbore penetrating a subterranean formation, pressurizing an axial flowbore of the casing string for a predetermined duration, wherein the pressure within the axial flowbore reaches at least a pressure threshold, wherein, upon pressurizing the axial flowbore for the predetermined duration, the pressure testing valve opens, and wherein a pressure substantially exceeding the pressure threshold is not applied to the casing string to open the pressure testing valve.

Further disclosed herein is a wellbore servicing method comprising pressure testing at a first pressure a tubing string positioned within a wellbore penetrating a subterranean formation, wherein the pressure test comprises an application of pressure for a predetermined duration, wherein during at least a portion of the predetermined duration, the application of pressure is of at least a pressure threshold, and wherein a pressure substantially exceeding the pressure threshold is not applied to the casing string during the pressure test, following the predetermined duration, flowing a fluid down the tubing string and into the wellbore or the subterranean formation.

Further disclosed herein is a pressure testing valve comprising a housing comprising one or more ports, a sliding sleeve, slidably positioned within the housing and movable from a first position with respect to the housing to a second position with respect to the housing, wherein, in the first position, the sliding sleeve blocks a route of fluid communication via the one or more port, and wherein, in the second position, the sliding sleeve does not block the route of fluid communication via the ports; and a fluid delay system, wherein the fluid delay system is generally configured to control the movement of the sliding sleeve from the first position to the second position.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
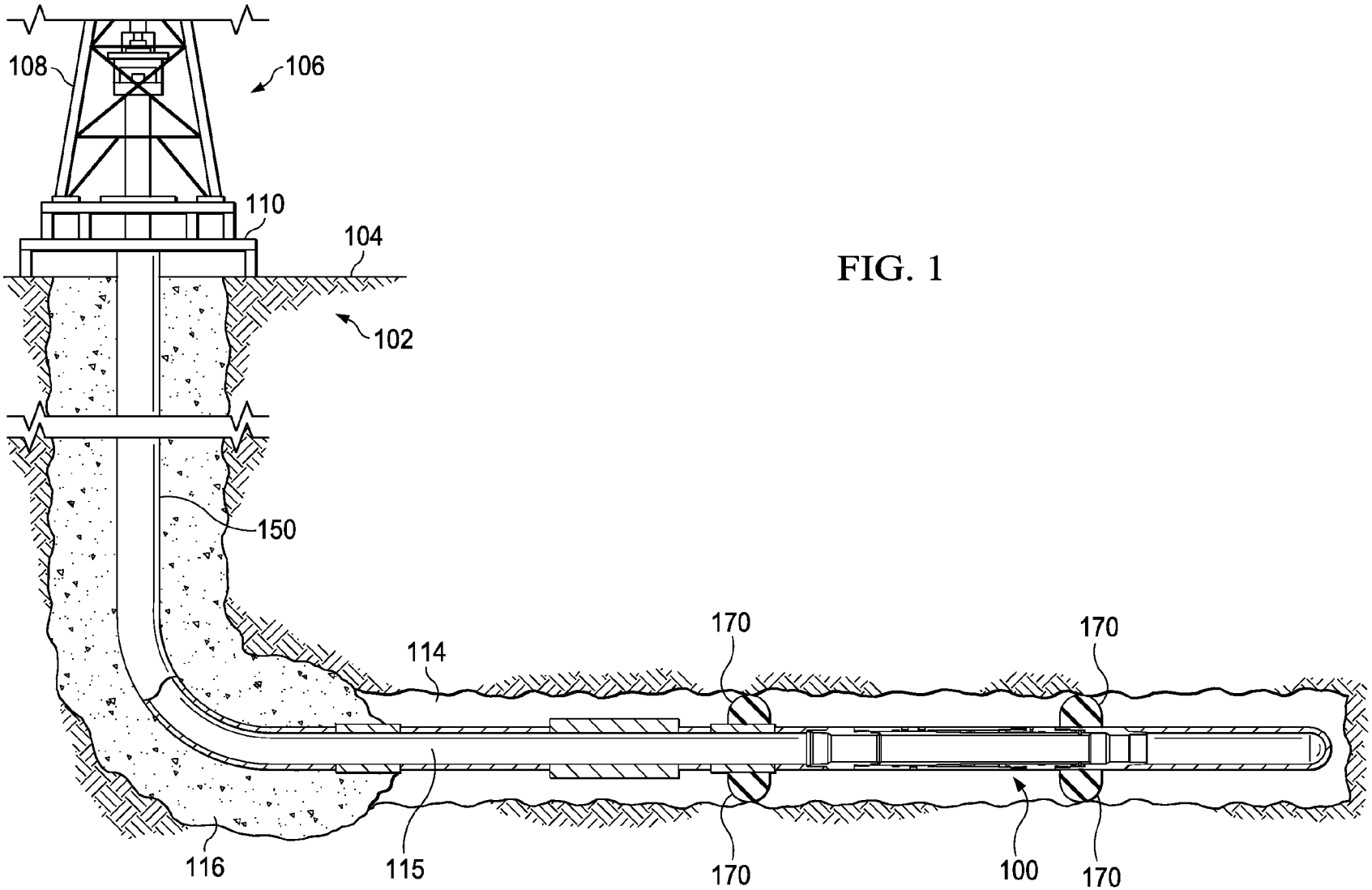
FIG. 1 is a partial cut-away view of an operating environment of an interruptible pressure testing valve depicting a wellbore penetrating a subterranean formation and a casing string having an interruptible pressure testing valve incorporated therein and positioned within the wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of an interruptible pressure testing valve (IPTV), as well as systems and methods employing the same. Particularly, disclosed herein are one or more embodiments of a IPTV incorporated within a tubular string, for example, a casing string or liner, which may comprise one or more wellbore servicing tools positioned within a wellbore penetrating a subterranean formation.

Where a casing string has been placed within a wellbore and, for example, prior to the commencement of stimulation (e.g., perforating and/or fracturing) operations, it may be desirable to pressure test the casing string or liner and thereby verify its integrity and functionality. In the embodiments disclosed herein, an IPTV enables the casing string to be pressure tested and, subsequently, allows a route of fluid communication from a flowbore of the casing string to/into the wellbore and surrounding formation without the use of excessive pressure threshold levels. Additionally, such an IPTV enables a pressure test to be suspended (e.g., interrupted) after having been commenced and later resumed, for example, following repairs to a casing string.

Referring to FIG. 1, an embodiment of an operating environment in which such an IPTV may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, the operating environment comprises a drilling or servicing rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 by any suitable drilling technique. In an embodiment, the drilling or servicing rig 106 comprises a derrick 108 with a rig floor 110 through which a casing string 150 generally defining an axial flowbore 115 may be positioned within the wellbore 114. The drilling or servicing rig 106 may be conventional and may comprise a motor driven winch and other associated equipment for lowering the casing string 150 into the wellbore 114 and, for example, so as to position the IPTV 100 and/or other wellbore servicing equipment at the desired depth.

In an embodiment the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In an embodiment, a portion of the casing string 150 may be secured into position against the formation 102 in a conventional manner using cement 116. In alternative embodiment, the wellbore 114 may be partially cased and cemented thereby resulting in a portion of the wellbore 114 being uncemented. In an embodiment, an IPTV 100 or some part or component thereof may be incorporated within the casing string 150. The IPTV 100 may be delivered to a predetermined depth within the wellbore 114. It is noted that although the IPTV is disclosed as being incorporated within a casing string in one or more embodiments, the specification should not be construed as so-limiting. An IPTV may similarly be incorporated within other suitable tubulars such as a work string, liner, production string, a length of tubing, or the like. For example, in an alternative embodiment, the IPTV 100 or some part/component thereof may be integrated and/or incorporated within a liner.

Referring to FIG. 1, the casing string 150 and/or the IPTV 100 may additionally or alternatively be secured within the wellbore 114 using one or more packers 170. In such an embodiment, the one or more packers 170 may generally comprise a device or apparatus which is configurable to seal or isolate two or more depths in a wellbore from each other, for example, by providing a barrier concentrically about a casing string and therebetween. Non-limiting examples of a packer as may be suitably employed as packer 170 include a mechanical packer or a swellable packer (for example, Swell-Packers™, commercially available from Halliburton Energy Services).

While the operating environment depicted in FIG. 1 refers to a stationary drilling or servicing rig 106 for lowering and setting the casing string 150 within a land-based wellbore 114, one of ordinary skill in the art will readily appreciate that alternative configuration, for example, mobile workover rigs and the like may be used to lower the casing string 150 into the wellbore 114. It should be understood that an IPTV 100 may be employed within other operational environments, such as within an offshore wellbore operational environment.

In an embodiment, the IPTV 100 is selectively configurable to either allow or disallow a route of fluid communication from a flowbore 124 thereof and/or the casing flowbore 115 to the formation 102 and/or into the wellbore 114, as will be disclosed herein. Particularly, the IPTV 100 may be configured so as to allow such a route of fluid communication upon the application of a predetermined fluid pressure (e.g., a fluid pressure of at least a threshold pressure) to the IPTV 100 (e.g., to the flowbore 124 thereof) for a predetermined duration, as will be disclosed herein. Additionally, the IPTV 100 may be configured such that application of fluid pressure of at least the threshold pressure need not be continuous (e.g., the duration over which the pressure is applied need not be continuous). Also, the fluid pressure may vary over the predetermined duration.

Figure 2A:
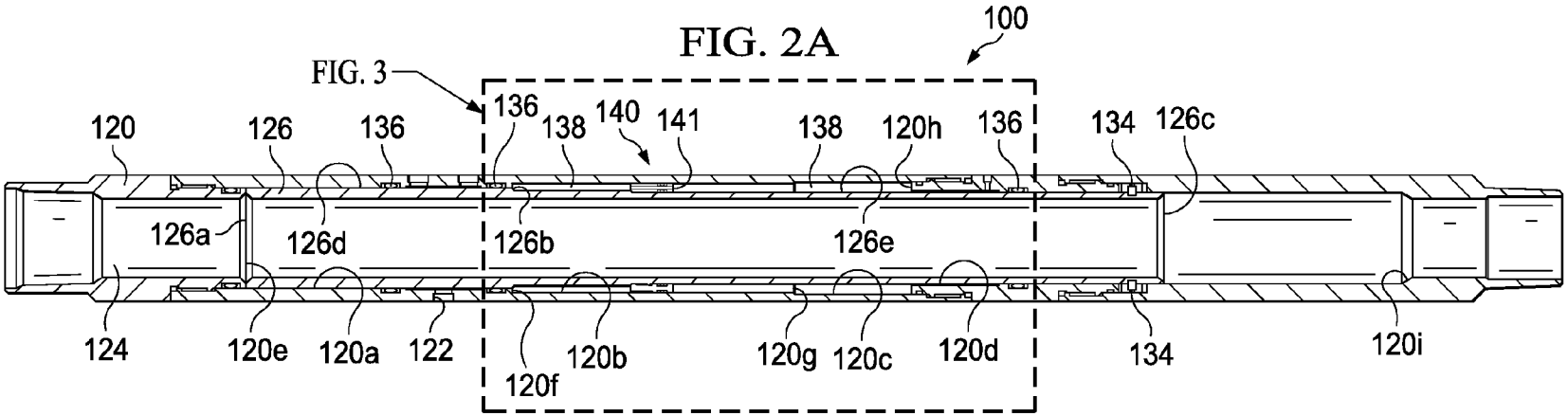
FIG. 2A is cut-away view of an embodiment of an interruptible pressure testing valve in a first configuration.
Figure 2B:
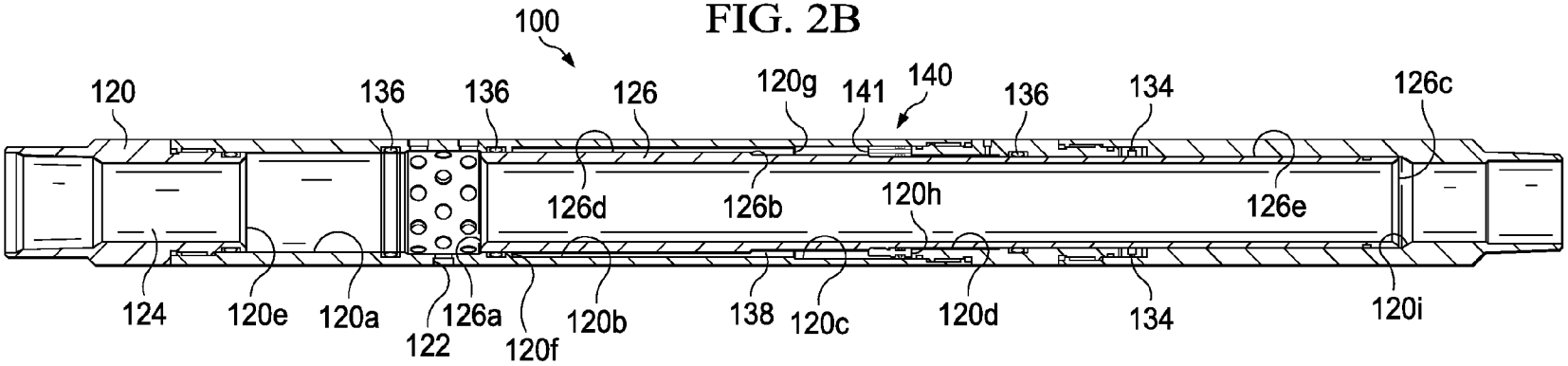
FIG. 2B is partial cut-away view of an embodiment of an interruptible pressure testing valve in a second configuration.

Referring to FIGS. 2A-2B, an embodiment of an IPTV 100 is illustrated. In an embodiment, the IPTV 100 may generally comprise of a housing 120 having one or more ports 122, a sliding sleeve 126, and a metering check valve assembly 140. In an embodiment, the IPTV 100 may be configured to be transitional from a first configuration to a second configuration. In an embodiment as will be disclosed herein, the IPTV 100 may be configured to transition from the first configuration to the second configuration upon the application of a pressure (e.g., a hydraulic fluid pressure) to the IPTV 100 of at least a first upper pressure threshold followed by a second upper pressure threshold for a predetermined duration of time.

In an embodiment as depicted in FIG. 2A, the IPTV 100 is illustrated in the first configuration. In the first configuration, the IPTV 100 is configured to disallow fluid communication via the one or more ports 122 of the IPTV 100. Additionally, in an embodiment, when the IPTV 100 is in the first configuration, the sliding sleeve 126 may be located (e.g., immobilized) in a first position within the IPTV 100, as will be disclosed herein.

In an embodiment as depicted in FIG. 2B, the IPTV 100 is illustrated in the second configuration. In the second configuration, the IPTV 100 is configured to disallow fluid communication via the one or more ports 122 of the IPTV 100. Additionally, in an embodiment, when the IPTV 100 is in the second configuration, the sliding sleeve 126 may be located (e.g., immobilized) in a second position within the IPTV 100, as will be disclosed herein.

In an embodiment, the housing 120 of the IPTV 100 is a generally cylindrical or tubular-like structure. In an embodiment, the housing 120 generally defines an axial flowbore 124. The housing 120 may comprise a unitary structure; alternatively, the housing 120 may be made up of two or more operably connected components (e.g., an upper component, and a lower component, which may be joined via a suitable connection, such as a welded or threaded connection). Alternatively, a housing of an IPTV 100 may comprise any suitable structure; such suitable structures will be appreciated by those of skill in the art with the aid of this disclosure.

In an embodiment the IPTV 100 may be configured for incorporation into the casing string 150, for example, as illustrated by the embodiment of FIG. 1, or alternatively, into any suitable string (e.g., a liner or other tubular such as a work string). In such an embodiment, the housing 120 may comprise a suitable connection to the casing string 150 (e.g., to a casing string member, such as a casing joint). For example, the housing 120 may comprise internally or externally threaded surfaces. Additional or alternative suitable connections to a casing string will be known to those of skill in the art upon viewing this disclosure.

Referring to FIG. 1, the IPTV 100 is incorporated within the casing string 150 such that the axial flowbore 124 of the IPTV 100 is in fluid communication with the axial flowbore 115 of the casing string 150. For example, the IPTV 100 is incorporated within the casing string 150 such that a fluid may be communicated between the axial flowbore 115 of the casing string 150 and the axial flowbore 124 of the IPTV 100.

In an embodiment, the housing 120 may comprise one or more shoulders, surfaces, or the like, generally defining one or more inner cylindrical surfaces of various diameters. Referring to FIGS. 2A and 2B, the housing 120 may comprise a first bore surface 120*a*, a second bore surface 120*b*, a third bore surface 120*c*, a fourth bore surface 120*d*, a first shoulder 120*e*, a second shoulder 120*f*, a third shoulder 120*g*, a fourth shoulder 120*h*, and a fifth shoulder 120*i*. In such an embodiment, the first bore surface 120*a* generally defines a cylindrical surface spanning between the first shoulder 120*e* and the second shoulder 120*f*, the second bore surface 120*b* generally defines a cylindrical surface spanning between the second shoulder 120*f* and the third shoulder 120*g*, the third bore surface 120*c* generally defines a cylindrical surface spanning between the third shoulder 120*g* and the fourth shoulder 120*h*, and the fourth bore surface 120*d* generally defines a cylindrical bore surface spanning between the fourth shoulder 120*h* and the fifth shoulder 120*i*. In such an embodiment, for example, in the embodiment of FIGS. 2A and 2B, the second bore surface 120*b* may be characterized as having a diameter greater than the diameter of the first bore surface 120*a*, the third bore surface 120*c* may be characterized as having a diameter greater than the diameter of the second bore surface 120*b*, and the first, second, and third bore surfaces, 120*a*, 120*b*, and 120*c*, respectively, may be characterized as having a diameter greater than the fourth bore surface 120*d*. Additionally, in such an embodiment, the first bore surface 120*a*, the second bore surface 120*b*, and/or the fourth bore surface 120*d* may further comprise grooves, channels, or the like, for example, for the placement of one or more seals, as will be disclosed herein.

In an embodiment, the housing 120 comprises one or more ports 122. In this embodiment, the ports 122 extend radially outward from and/or inward towards the axial flowbore 124.

As such, these ports 122 may provide a route of fluid communication from the axial flowbore 124 to an exterior of the housing 120 when the IPTV 100 is so-configured. For example, the IPTV 100 may be configured such that the ports 122 provide a route of fluid communication between the axial flowbore 124 and the wellbore 114 and/or subterranean formation 102 when the ports 122 are unblocked (e.g., by the sliding sleeve 126, as will be disclosed herein). Alternatively, the IPTV 100 may be configured such that no fluid will be communicated via the ports 122 between the axial flowbore 124 and the wellbore 114 and/or the subterranean formation 102 when the ports 122 are blocked (e.g., by the sliding sleeve 126, as will be disclosed herein). In an embodiment, the ports 122 may be configured to communicate a fluid at a given rate and/or pressure. For example, in an embodiment, the ports 122 may be fitted with one or more pressure-altering devices (e.g., nozzles, erodible nozzles, fluid jets, or the like). In an additional embodiment, the ports 122 may be fitted with plugs, screens, covers, or shields, for example, to prevent debris from entering the ports 122.

Referring to FIGS. 2A and 2B, the sliding sleeve 126 generally comprises a cylindrical or tubular structure comprising an axial flowbore extending there-through. In an embodiment the sliding sleeve 126 may comprise a unitary structure (e.g., a single solid piece). In an alternative embodiment, the sliding sleeve 126 may comprise two or more segments. In such an embodiment, the two or more segments of the sliding sleeve 126 may be coupled together, for example, by one or more threaded connection; alternatively, by any suitable methods as would be known by those of skill in the art upon viewing this disclosure.

In an embodiment, the sliding sleeve 126 may comprise one or more of shoulders, or the like, generally defining one or more cylindrical surfaces of various diameters. Referring to FIGS. 2A and 2B, in an embodiment, the sliding sleeve 126 comprises an upper face 126*a*, a lower face 126*c*, an intermediate shoulder 126*b*, a first outer cylindrical surface 126*d* spanning between the upper face 126*a* and the intermediate shoulder 126*b*, and a second outer cylindrical surface 126*e* spanning between the intermediate shoulder 126*b* and the lower face 126*c*.

Figure 3:
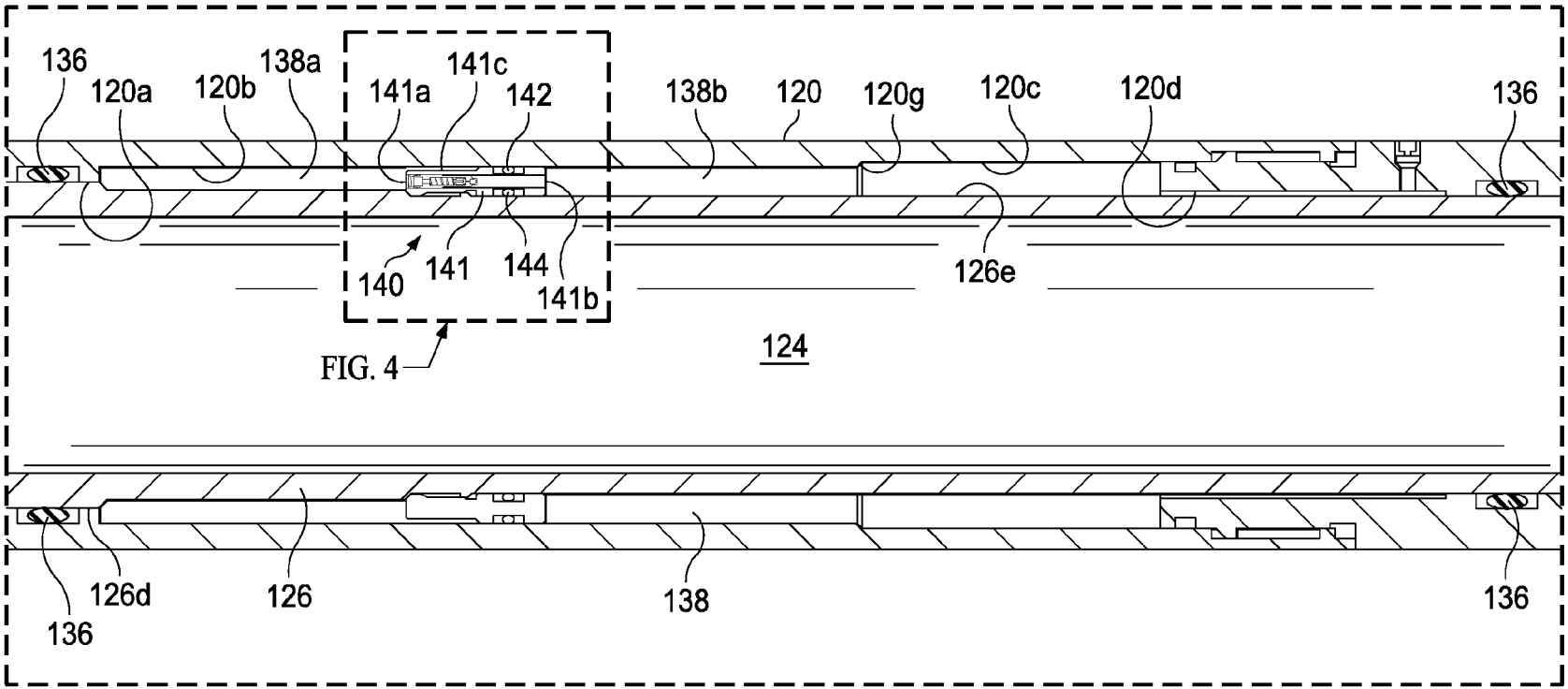
FIG. 3 is a cut-away view of a medial portion of an interruptible pressure testing valve.

In an embodiment, the sliding sleeve 126 may further comprise a collar 141 disposed about the sliding sleeve 126. For example, in the embodiment of FIGS. 2A and 2B, the collar 141 is disposed about the second outer cylindrical surface 126*e*. In an embodiment, the collar 141 may comprise a separate component which may be suitable coupled to the sliding sleeve 126. For example, in the embodiment of FIGS. 2A and 2B, the collar 141 comprises a separate component coupled to the sliding sleeve 126 via a threaded connection. In an alternative embodiment, the collar 141 may be formed as an integral component of the sliding sleeve 126. Referring to FIG. 3, an expanded view of the sliding sleeve 126, particularly, of the collar 141, is illustrated. In an embodiment, the collar 141 may comprise an upper shoulder 141*a*, a lower shoulder 141*b*, and a third outer cylindrical surface 141*c* spanning between the upper shoulder 141*a* and the lower shoulder 141*b*.

In an embodiment, the sliding sleeve 126 may be slidably and concentrically positioned within the housing 120. In an embodiment, the sliding sleeve 126 may be slidably movable, with respect to the housing 120, from a first position to a second position with respect to the housing 120.

For example, in the embodiment of FIGS. 2A, 2B, and 3, at least a portion of the first outer cylindrical bore surface 126*d* of the sliding sleeve 126 may be slidably fitted against at least a portion of the first bore surface 120*a* of the housing 120 and at least a portion of the second outer cylindrical bore surface 126*e* of the sliding sleeve 126 may be slidably fitted against at least a portion of the fourth bore surface 120*d* of the housing 120. Also, in the embodiment of FIGS. 2A and 3 (for example, where the sliding sleeve 126 is in the first position), the third outer cylindrical surface 141*c* of the collar 141 may be slidably fitted against at least a portion of the second bore surface 120*b* of the housing 120. In the embodiment of FIG. 2B (for example, where the sliding sleeve 126 is in the second position) the third outer cylindrical surface 141*c* of the collar 141 may be longitudinally aligned with/proximate to the third bore surface 120*c* of the housing 120 (although, not necessarily slidably engaging the third bore surface 120*c*).

In an embodiment, one or more of the interfaces between the sliding sleeve 126 and the housing 120 may be fluid-tight and/or substantially fluid-tight. For example, in an embodiment, the housing 120 and/or the sliding sleeve 126 may comprise one or more suitable seals at such an interface, for example, for the purpose of prohibiting or restricting fluid movement via such an interface. Suitable seals include but are not limited to a T-seal, an O-ring, a gasket, or combinations thereof. In the embodiment of FIGS. 2A, 2B, and 3, the IPTV 100 comprises a plurality of fluid seal 136 (e.g., one or more O-rings or the like) at the interface between the first bore surface 120*a* and the second outer cylindrical bore surface 126*e*, and at the interface between the second outer cylindrical bore surface 126*e* and the fourth bore surface 120*d*.

Additionally, in an embodiment, because the interface between the first bore surface 120*a* and the second outer cylindrical bore surface 126*e* and the interface between the second outer cylindrical bore surface 126*e* and the fourth bore surface 120*d* are fluidicly sealed (e.g., by fluid seals 136), as disclosed above, there is a resulting chamber 138 which is unexposed to hydraulic fluid pressures applied to the axial flowbore 124.

Also, in an embodiment (and dependent upon the position of the sliding sleeve 126 relative to the housing 120, as will be disclosed herein), the interface between the third outer cylindrical surface 141*c* (of the collar 141) and the second bore surface 120*b* of the housing 120 may be fluidicly sealed, for example, by a first fluid seal 142 (e.g., one or more O-rings or the like). Additionally, in the embodiment of FIG. 3 (for example, where the collar 141 is threadedly or otherwise coupled around the sliding sleeve 126), a second fluidic seal 144 may fluidicly seal the interface between the collar 141 and the sliding sleeve 126.

In an embodiment, the sliding sleeve 126 may be positioned so as to allow or disallow fluid communication via the one or more ports 122 between the axial flowbore 124 of the housing 120 and the exterior of the housing 120, dependent upon the position of the sliding sleeve 126 relative to the housing 120. Referring to FIG. 2A, the sliding sleeve 126 is illustrated in the first position. In the first position, the sliding sleeve 126 blocks the ports 122 of the housing 120 and, thereby, restricts fluid communication via the ports 122. As noted above, when the sliding sleeve 126 is in the first position, the IPTV 100 may be in the first configuration. Referring to FIG. 2B, the sliding sleeve 126 is illustrated in the second position. In the second position, the sliding sleeve 126 does not block or obstruct the ports 122 of the housing 120 and, thereby allows fluid communication via the ports 122. As noted above, when the sliding sleeve 126 is in the second position, the IPTV 100 may be in the second configuration.

In an embodiment, the sliding sleeve 126 may be configured to be selectively transitioned from the first position to the second position. For example, in an embodiment the sliding sleeve 126 may be configured to transition from the first position to the second position (e.g., a sliding sleeve stroke) upon the application of a hydraulic pressure to the axial flowbore 124 for a predetermined duration (e.g., a pressure, over at least a portion of the predetermined duration, of at least a pressure threshold), as will be disclosed herein. In such an embodiment, the sliding sleeve 126 may comprise a differential in the surface area of the upward-facing surfaces which are fluidicly exposed to the axial flowbore 124 (e.g., the upper face 126*a*) and the surface area of the downward-facing surfaces which are fluidicly exposed to the axial flowbore 124 (e.g., the lower face 126*c*), for example, because the intermediate shoulder 126*b* is unexposed (e.g., is fluidicly sealed from the axial flowbore 124, as disclosed herein). For example, in the embodiment of FIGS. 2A, 2B, and 3, the surface area of the surfaces of the sliding sleeve 126 which will apply a force (e.g., a hydraulic force) in the direction toward the second position (e.g., an downward force) may be greater than surface area of the surfaces of the sliding sleeve 126 which will apply a force (e.g., a hydraulic force) in the direction away from the second position (e.g., an upward force). In an additional or alternative embodiment, an IPTV like IPTV 100 may further comprise one or more additional chambers similarly configured to provide such a differential (e.g., upon the application of a fluid pressure) in the force applied to the sliding sleeve 126 in the direction toward the second position (e.g., an upward force) and the force applied to the sliding sleeve 126 in the direction away from the second position (e.g., a downward force), as will be disclosed herein.

In an embodiment, the sliding sleeve 126 may be retained in the first position and/or the second position by a suitable retaining mechanism, as will be disclosed herein. For example, in the embodiment of FIG. 2A, the sliding sleeve 126 may be held in the first position by one or more frangible members, such as one or more shear pins 134. Such shear pins 134 may extend between the housing 120 and the sliding sleeve 126. The shear pins 134 may be inserted or positioned within a suitable borehole in the housing 120 and the borehole in the sliding sleeve 126. As will be appreciated by one of skill in the art, the shear pin 134 may be sized/configured to shear or break upon the application of a desired magnitude of force (e.g., force resulting from the application of a hydraulic fluid pressure, such as a pressure test) to the sliding sleeve 126, as will be disclosed herein. In an alternative embodiment, the sliding sleeve 126 may be held in the first position by any suitable frangible member, such as a shear ring or the like.

Also, in an additional or alternative embodiment, the sliding sleeve 126 may be retained in the second position by suitable a retaining mechanism. For example, in an embodiment, the sliding sleeve 126 may be retained in the second position by a snap-ring, alternatively, by a C-ring, a biased pin, ratchet teeth, or combinations thereof. In such an embodiment, the snap-ring (or the like) may be carried in a suitable slot, groove, channel, bore, or recess in the sliding sleeve, alternatively, in the housing, and may expand into and be received by a suitable slot groove, channel, bore, or recess in the housing, or, alternatively, in the sliding sleeve 126. Additionally or alternatively, the sliding sleeve 126 may be retained in the second position via the application of fluid pressure to the sliding sleeve 126, for example, resulting in a force in the direction of the second position via the differential in the forces applied to the sliding sleeve 126, as disclosed herein.

In an embodiment, the sliding sleeve 126 may be configured to transition from the first position to the second position at a controlled rate, at a predetermined rate, within a predetermined duration, or combinations thereof. For example, in an embodiment, the IPTV 100 may be configured such that the sliding sleeve 126 will transition from the first position to the second position within a predetermined duration of from about 5 minutes to about 120 minutes, alternatively, from about 15 minutes to about 60 minutes, alternatively, from about 20 minutes to about 40 minutes, alternatively of about 30 minutes, alternatively, any suitable duration. For example, in an embodiment, the IPTV 100 may be configured such that the sliding sleeve 126 will transition from the first position to the second position after a delay of greater than about 1, 3, 5, 7, 10, 15, 20, 25, 30, 35, 40, 45, 50, 55, 60, or more minutes.

Figure 4:
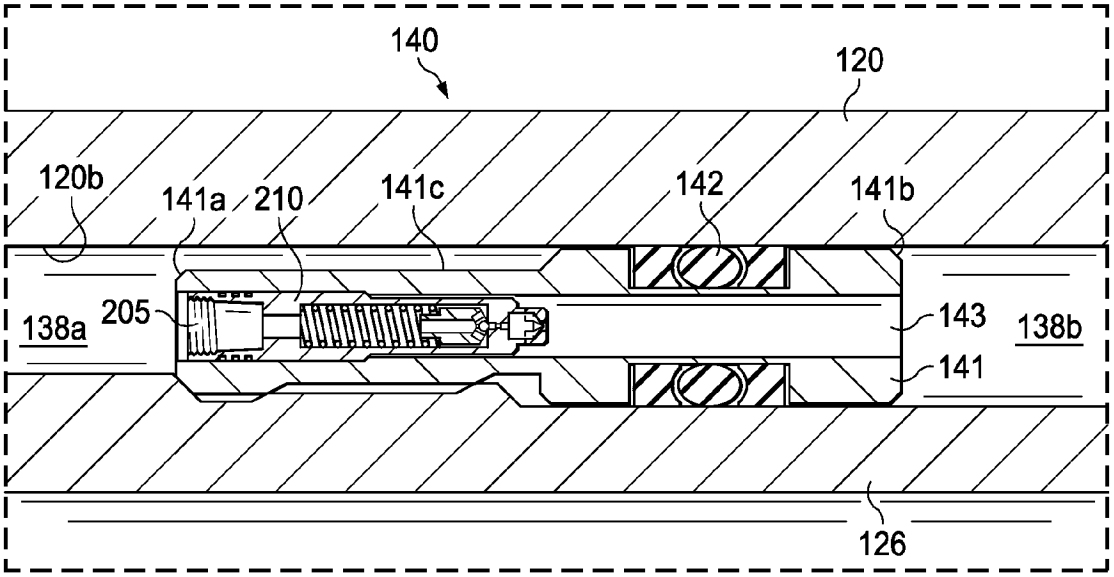
FIG. 4 is a cut-away view of a metering check valve assembly within an interruptible pressure testing valve.

For example, in an embodiment, the IPTV 100 may further comprise a delay system, such as a fluid delay system. For example, in an embodiment, the IPTV 100 comprises a metering check valve assembly 140. Referring to FIG. 4, an embodiment of the metering check valve assembly 140 is illustrated. In the embodiment of FIG. 4, the metering check valve assembly 140 is disposed within the collar 141, which is disposed about the exterior of the sliding sleeve 126; alternatively, which may be formed as a part of or incorporated within the sliding sleeve 126. In such an embodiment (e.g., as illustrated in FIG. 4), the metering check valve assembly 140 may comprise a flowbore 143 extending longitudinally through the collar 141 and a metering check valve 210 may be disposed within the flowbore 143.

In an embodiment, and as disclosed herein, the collar 141 may be slidably and concentrically positioned within the housing 120. For example, in the embodiment of FIGS. 2A and 3 (for example, wherein the sliding sleeve 126 is in the first position), the third outer cylindrical surface 141*c* of the collar 141 may be slidably fitted against at least a portion of the second bore surface 120*b* of the housing 120, for example, fluidicly tight as by the seal 142. As such, when the third outer cylindrical surface 141*c* of the collar 141 interfaces with the second bore surface 120*b* of the housing 120 (e.g., a first portion of the sliding sleeve stroke), the collar 141 may partition (e.g., provide fluid isolation between various portions of) the chamber 138, for example, forming a first chamber portion 138*a* and a second chamber portion 138*b*.

Also, as illustrated in the embodiment of FIG. 2B (for example, where the sliding sleeve 126 is in the second position) when the third outer cylindrical surface 141*c* of the collar 141 is longitudinally aligned with/proximate to the third bore surface 120*c* of the housing 120 (e.g., a second portion of the sliding sleeve stroke), the third outer cylindrical surface 141*c* may not fluidicly sealingly engage the third bore surface 120*c*), thereby allowing fluid communication between the first chamber portion 138*a* and the second chamber portion 138*b*, as will be disclosed herein.

In an embodiment, the second chamber 138*b* may be filled and/or at least partially filled with a suitable fluid (e.g., a hydraulic fluid). In an embodiment, the fluid may be characterized as having a suitable rheology. In an embodiment, the fluid may be characterized as substantially incompressible. In an embodiment, the fluid may be characterized as having a suitable bulk modulus, for example, a relatively high bulk modulus. For example, in an embodiment, the fluid may be characterized as having a bulk modulus in the range of from about 1.8 $10^5$ psi, $lb_f/in^2$ to about 2.8 $10^5$ psi, $lb_f/in^2$ from about 1.9 $10^5$ psi, $lb_f/in^2$ to about 2.6 $10^5$ psi, $lb_f/in^2$, alternatively, from about 2.0 $10^5$ psi, $lb_f/in^2$ to about 2.4 $10^5$ psi, $lb_f/in^2$. In an additional embodiment, the fluid may be characterized as having a relatively low coefficient of thermal expansion. For example, in an embodiment, the fluid may be characterized as having a coefficient of thermal expansion in the range of from about 0.0004 cc/cc/° C. to about 0.0015 cc/cc/° C., alternatively, from about 0.0006 cc/cc/° C. to about 0.0013 cc/cc/° C., alternatively, from about 0.0007 cc/cc/° C.

to about 0.0011 cc/cc/° C. In another additional embodiment, the fluid may be characterized as having a stable fluid viscosity across a relatively wide temperature range (e.g., a working range), for example, across a temperature range from about 50° F. to about 400° F., alternatively, from about 60° F. to about 350° F., alternatively, from about 70° F. to about 300° F. In another embodiment, the fluid may be characterized as having a viscosity in the range of from about 50 centistokes to about 500 centistokes. Examples of a suitable fluid include, but are not limited to oils, such as synthetic fluids, hydrocarbons, or combinations thereof. Particular examples of a suitable fluid include silicon oil, paraffin oil, petroleum-based oils, brake fluid (glycol-ether-based fluids, mineral-based oils, and/or silicon-based fluids), transmission fluid, synthetic fluids, or combinations thereof.

In an embodiment, the metering check valve 210 may be configured so as to allow or disallow a route of fluid communication via the flowbore 143 of the metering check valve assembly 141, for example, dependent upon the direction of fluid movement through the flowbore 143. Also, in an embodiment, the metering check valve 210 may be configured to allow fluid communication, in a given direction, at a predetermined rate. In such an embodiment, the metering check valve 210 may be joined, incorporated, and/or integrated within the metering check valve assembly 140 (e.g., within the flowbore 143 of the collar 141) via any suitable connection or coupling, for example, via an internally and/or externally threaded interface.

Figure 5:
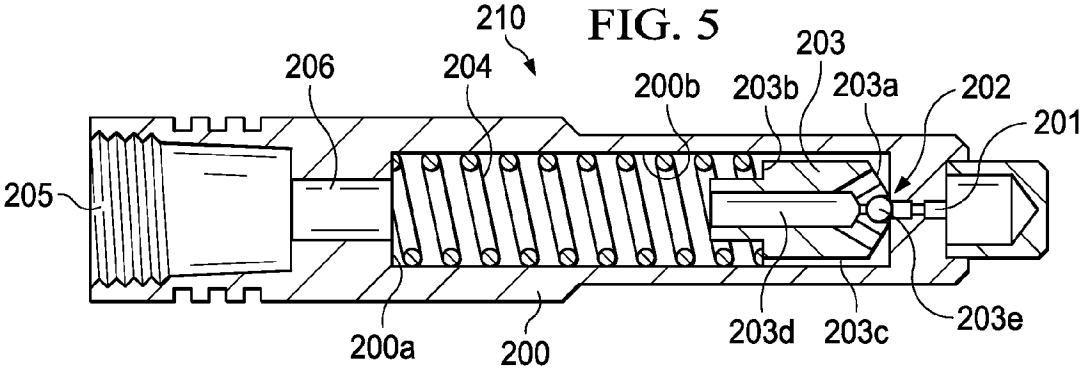
FIG. 5 is cut-away view of a metering check valve of an interruptible pressure testing valve.

Referring to FIG. 5, an embodiment of the metering check valve 210 is illustrated. In the embodiment illustrated in FIG. 5, the metering check valve 210 may comprise a valve body 200 generally defining a flowpath 206 (e.g., a bore) extending therethrough, a valve member 203, and a biasing member 204. In an embodiment, the valve body 200 may comprise an inlet port 201, a seat 202, a biasing member support face 200*a*, a valve bore surface 200*b* extending between the seat 202 and the support face 200*a*, and an outlet 205. In such an embodiment, the metering check valve 210 may be positioned within the collar 141 such that the inlet port 201 and/or the outlet port 205 may be in fluid communication with the flowbore 143 of the metering check valve assembly 141. For example, in an embodiment, a fluid may be communicated through the flowbore 143 of the metering check valve assembly 141 via the metering check valve 210, when so configured, as will be disclosed herein. Additionally, in an embodiment, the valve member 203 may comprise a first valve member orthogonal surface 203*a*, a second valve member orthogonal surface 203*b*, and a cylindrical valve member surface 203*c* spanning between the first valve member orthogonal surface 203*a* and the second valve member orthogonal surface 203*b*. The valve member 203 may also comprise one or more interconnected flowbores 203*d* generally extending therethrough.

In an embodiment, the valve member 203 may be slidably and concentrically positioned within the valve body 200. For example, in an embodiment, at least a portion of the cylindrical valve member surface 203*c* may be slidably fitted within at least a portion of the valve bore surface 200*b* of the valve body 200.

In an embodiment, the valve member 203 may be moveable with respect to the valve body 200, for example, from a first position to a second position with respect to the valve body 200. For example, in an embodiment, the valve member 203 may be positioned so as to allow or disallow a route of fluid communication via the inlet port 201 and the outlet port 205, dependent upon the position of the valve member 203 relative to the valve body 200. In such an embodiment, in the first position, the valve member 203 engages (e.g., sealingly engages, for example, via a ball 203*e* located within the first valve member orthogonal surface 203*a*) the seat 202 of the valve body 200, for example, and blocks fluid communication from the inlet port 201 of the valve body 200 to the outlet port 205. Also, in such an embodiment, in the second position, the valve member 203 does not block fluid communication from the inlet port 201 of the valve body 200 to the outlet port 205 and, thereby allows fluid communication, for example, fluid may flow from the second chamber 138*b* to the first chamber 138*a* via the inlet port 201.

Additionally, in an embodiment, the biasing member 204 (e.g., a spring) may be generally configured to bias the valve member 203 in the direction of the first position. For example, in the embodiment of FIG. 5, the biasing member 204 is positioned and/or configured so as to engage the second valve member orthogonal surface 203*b* and the biasing support face 200*a* of the valve body 200. In such an embodiment, the biasing member 204 may apply a force to the second valve member surface 203*b*, for example, to move the valve member 203 toward the first position.

In an embodiment, the valve member 203 may be configured to transition from the first position to the second position. For example, in an embodiment, the valve member 203 may be configured to transition from the first position to the second position upon an application of a fluid pressure (e.g., a differential, hydraulic pressure) of at least a biasing member compression threshold to the inlet port 201 side of the flowbore 143. In such an embodiment, the biasing member compression threshold may be the force required to overcome a biasing force by the biasing member 204, for example, so as to compress (or further compress) the biasing member 204. For example, the metering check valve 210 may be configured such that, upon the application of a fluid pressure to the inlet port 201 sufficient to compress the biasing member 204, the valve member 203 will unseat from the seat 202 of the valve body 200 in move toward the second position, thereby allowing fluid to be communicated from the inlet port 201 to the outlet port 205, for example, via the flowbores 203*d* of the valve member 203 and/or the flowpath 206 through the valve body 200. As such, the metering check valve 210 may be configured such that fluid may only be communicated therethrough from the inlet port 201 in the direction of the outlet port 205. Also, the valve member 203 may be configured so as to not transition from the first position to the second upon the upon the application of fluid pressure to the outlet port 205 side of the flow bore 143.

In an embodiment, the metering check valve 210 may be configured to allow fluid communication (e.g., upon fluid communication from the inlet port 201 in the direction of the outlet port 205) at a predetermined rate. For example, the metering check valve 210 (e.g., the inlet port, the outlet port 205, the central flowpath 206, or combinations thereof) may comprise a flow-rate altering device, for example, a fluid meter, a fluidic diode, a fluidic restrictor, an orifice, a nozzle or the like. In an embodiment, such a flow-rate altering device may be sized to allow a given flow-rate of fluid, and thereby provide a desired time or delay associated with flow of fluid from the second chamber portion 138*b* to the first chamber portion 138*a* and, as such, the movement of the sliding sleeve 126. Suitable fluid flow-rate control devices are commercially available from The Lee Company of Westbrook, Conn. and include, but are not limited to, a precision microhydraulics fluid restrictor, a micro-dispensing valve, or fluid jets such as the Lee Visco Jet, the Lee Micro Jet, or the Lee Jeva Jet products. Additionally, in such an embodiment, a flow-rate control device may similarly be included within the flowbore 143 through the collar, for example, so as to similarly control the rate of fluid movement from the second chamber portion 138*b* to the first chamber portion 138*a*. Examples of suitable metering check valves 210 are commercially available as the Lee Chek line of check valves from The Lee Company.

In an embodiment, a wellbore servicing method utilizing the IPTV 100 and/or a wellbore servicing system comprising an IPTV 100 is disclosed herein. In an embodiment, a wellbore servicing method may generally comprise the steps of positioning the casing string 150 comprising a IPTV 100 within a wellbore 114 that penetrates the subterranean formation 102, and pressure testing the casing string 150 (which may comprise applying a fluid pressure of at least an upper threshold within the casing string 150 and maintaining fluid pressure within the casing string 150 for a predetermined duration of time, as will be disclosed herein). In an additional embodiment, a wellbore servicing method may further comprise one or more of the steps of communicating a fluid via the IPTV 100, actuating a wellbore servicing tool (e.g., a wellbore stimulation tool), communicating a wellbore servicing fluid via the wellbore servicing tool, and/or producing a formation fluid from the formation.

Referring to FIG. 1, in an embodiment the wellbore servicing method comprises positioning or "running in" a casing string 150 comprising the IPTV 100, for example, into a wellbore. In an embodiment, for example, as shown in FIG. 1, the IPTV 100 may be integrated within a casing string 150, for example, such that the IPTV 100 and the casing string 150 comprise a common axial flowbore. Thus, a fluid introduced into the casing string 150 will be communicated to the IPTV 100.

In the embodiment, the IPTV 100 is introduced and/or positioned within a wellbore 114 (e.g., incorporated within the casing string 150) in a first configuration, for example, as shown in FIG. 2A. For example, as disclosed herein, in the first configuration, the sliding sleeve 126 may be held in the first position by at least one shear pin 134 and/or the fluid delay system, thereby blocking fluid communication via the ports 122 of the housing 120. Also, in an embodiment, the first chamber 138*a* may be substantially free of a fluid (e.g., a hydraulic fluid) and the second chamber 138*b* may be at least partially filled (e.g., substantially filled) with a fluid (e.g., a hydraulic fluid).

In an embodiment, positioning the IPTV 100 may comprise securing the casing string with respect to the formation. For example, in the embodiment of FIG. 1, positioning the casing string 150 having the IPTV 100 incorporated therein may comprise cementing (so as to provide a cement sheath 116) the casing string 150 and/or deploying one or more packers (such as packers 170) at a given or desirable depth within a wellbore 114. In alternative embodiments, an IPTV like IPTV 100 disclosed herein may be similarly integrated within another type and/or configuration of tubing sting, which may be similarly run into a wellbore and, in some embodiments secured therein.

In an embodiment, the wellbore servicing method comprises pressure testing the casing string 150. For example, in embodiment, during the performance of such a pressure test, a pressure, for example, a pressure of at least a threshold pressure, may be applied to the casing string 150 for a given, predetermined duration. Such a pressure test may be employed to assess the integrity of the casing string 150 and/or components incorporated therein, for example, ensuring that the casing string 150 will withstand such pressures. In an embodiment, pressure testing the casing string 150 may generally comprise applying a hydraulic to/within the casing string 150 and maintaining the application of fluid pressure within the casing string 150 for a predetermined duration.

In an embodiment (for example, in the performance of a pressure test), the wellbore servicing method comprises applying a hydraulic fluid pressure within the casing string 150, for example, by pumping a fluid into the casing via one or more pumps typically located at the surface, such that the pressure within the casing string 150 reaches an upper threshold.

In an embodiment, the pressure applied to the casing string 150, for at least a portion of a predetermined duration over which the pressure is applied, as will be disclosed herein, may be of at least a pressure threshold. For example, the threshold pressure may be at least about 8,000 p.s.i., alternatively, at least about 10,000 p.s.i., alternatively, at least about 12,000 p.s.i., alternatively, at least about 15,000 p.s.i., alternatively, at least about 18,000 p.s.i., alternatively, at least about 20,000 p.s.i., alternatively, any suitable pressure about equal to or less than the pressure at which the casing string 150 is rated.

In an embodiment, the application of such a hydraulic fluid pressure (e.g., applied for a predetermined duration) may be effective to transition the sliding sleeve 126 from the first position to the second position. For example, the hydraulic fluid pressure may be applied through the axial flowbore 124, including to the sliding sleeve 126 of the IPTV 100. As disclosed herein, the application of a fluid pressure to the IPTV 100 may yield a force applied to the sliding sleeve 126 in the direction of the second position, for example, because of the differential between the force applied to the sliding sleeve 126 in the direction toward the second position (e.g., an downward force) and the force applied to the sliding sleeve in the direction away from the second position (e.g., a upward force).

In an embodiment, the IPTV 200 may be configured such that the application of a hydraulic fluid pressure of a predetermined magnitude (e.g., the pressure threshold) may exert a force in the direction of the second position sufficient to shear the one or more shear pins 134, for example, thereby causing the sliding sleeve 126 to begin to move in the direction of the second position (e.g., as controlled by the fluid delay system). Additionally or alternatively, in an embodiment, application of fluid pressure to the IPTV 100 to may be sufficient to cause the hydraulic fluid within the second chamber portion 138*b* to flow through the flowbore 143 of the metering check valve assembly 141. In such an embodiment, the hydraulic fluid within the inlet port 201 may exert a force onto the valve member 203 sufficient to transition the valve member 203 from first position to the second position. For example, as the sliding sleeve 126 begins to move in the direction of the second position, the hydraulic fluid within the second chamber portion 138 becomes compressed and, thereby, exerts a force against the valve member 203, causing the metering check valve 210 to open and flow to move from the second chamber portion 138*b* to the first chamber portion 138*a* via the flowbore 143. In an embodiment, the force (e.g., the fluid pressure) necessary to shear the one or more shear pins 134 may be about the same as the force necessary to cause the hydraulic fluid to move (or continue to move) through the metering check valve 210 (e.g., to open the metering check valve, as disclosed herein). Alternatively, the force (e.g., the fluid pressure) necessary to shear the one or more shear pins 134 may be greater than, alternatively, less than, the force necessary to cause the hydraulic fluid to continue to move through the metering check valve 210. In such embodiments, the force (e.g., fluid pressure) applied to the sliding sleeve 126 to transition to the second position may vary over the travel of the sliding sleeve 126.

Also, in an embodiment (for example, in the performance of a pressure test), the wellbore servicing method comprises maintaining the application of fluid pressure to the casing string 150. In an embodiment, the pressure may applied to the casing string 150 over a predetermined duration, as will be disclosed herein. For example, the predetermined duration may be from about 5 minutes to about 120 minutes, alternatively, from about 15 minutes to about 60 minutes, alternatively, from about 20 minutes to about 40 minutes, alternatively of about 30 minutes, alternatively, any suitable duration. For example, in the performance of a pressure test, the pressure applied to the casing string 150 may be maintained for a sufficient duration to ensure the integrity of the casing string 150 and/or any components incorporated therein, as disclosed herein. In an embodiment, the duration over which the pressure is applied to the casing string 150 may also be sufficient to allow the sliding sleeve 126 to transition from the first position to the second position. For example, the IPTV 100 may be configured such that the sliding sleeve 126 will reach the second position, as will be disclosed herein, substantially contemporaneously with the end of the predetermined duration. Also, the predetermined duration may be configured for any suitable duration via the manipulation of one or more of the size of the second chamber portion 138*b*; the size, number, and/or configuration of the metering check valve that is utilized (e.g., the rate at which the metering check valve is configured to allow fluid communication); the characteristics of the fluid (e.g., the hydraulic fluid) that is retained within the second chamber portion 138*b*; or combinations thereof.

In an embodiment, as the fluid pressure continues to be applied to the sliding sleeve 126, the hydraulic fluid continues to move through the flowbore 143 of the collar 141, thereby allowing the sliding sleeve 126 to move (e.g., slide) in the direction of the second position until the collar 141 reaches the third shoulder 120*g* of the housing 120. Upon reaching and/or passing the third shoulder 120*g*, the third outer cylindrical surface 141*c* of the collar 141 ceases to sealingly engage the second bore surface 120*b* of the housing 120, for example, because the collar 141 becomes longitudinally aligned with the third bore surface 120*c* of the housing 120 and does not sealingly engage the third bore surface 120*c*. In such an embodiment, the hydraulic fluid is allowed to move relatively freely from the second chamber portion 138*b* to the first chamber portion 138*a*, thereby allowing the sliding sleeve 126 to move toward the second position with the application of relatively little force. In an alternative embodiment, the third bore surface 120*c*, rather than having a greater diameter, may comprise one or more longitudinal grooves, similarly allowing fluid to bypass the flowbore 143 of the collar 141.

The sliding sleeve 126 moves toward the second position, for example, until the second surface 141*b* of the metering check valve assembly 141 engages the fourth shoulder 120*h* of the housing 120, thereby preventing or restricting the sliding sleeve 126 from further movement. Additionally, in an embodiment the hydraulic fluid within the first chamber 138*a* may apply a force onto the metering check valve assembly 141 restricting and/or preventing the sliding sleeve 126 from moving fully to the first position. Thus, the sliding sleeve 126 is retained in the second position in which the ports 122 of the housing 120 are no longer blocked, thereby allowing fluid communication out of the casing string 150 (e.g., to the wellbore 114, the subterranean formation 102, or both) via the ports 122 of the housing 120.

In an embodiment, the duration over which the pressure is applied to the casing string 150 need not be continuous. For example, the application of pressure (e.g., during the performance of a pressure test) may comprise one or more interruptions. For example, during the performance of a pressure test, an interruption in the pressure applied to the casing string 150 may result intentionally or unintentionally. In such an embodiment, the predetermined duration of time may comprise one or more subintervals of time (e.g., a first subinterval, a second subinterval). For example, in an embodiment, to transition the sliding sleeve 126 to the second position, the fluid pressure may be applied to the casing string 150 in two or more intervals (for example, a first subinterval of about five minutes and a second subinterval of about twenty-five minutes). In such an embodiment, the second subinterval may occur following one or more periods of time when the fluid pressure applied to the casing string 150 falls below the threshold pressure, for example, a period of time when the applied fluid pressure to the casing string 150 is reduced below the upper threshold pressure to inspect and/or repair a portion of the casing string 150. For example, it is not necessary that the fluid pressure of at least the pressure threshold be applied continuously for the predetermined duration; the predetermined duration may be interrupted (e.g., the pressure may fall below the pressure threshold) on one or more occasions while the sliding sleeve 126 transitions toward the second position. For example, in an embodiment where the fluid pressure within the casing string falls below the threshold pressure, the metering check valve 210 may close and the sliding sleeve 126 will cease to move in the direction of the second position. Upon resuming the pressure test (e.g., upon reapplying a fluid pressure, as disclosed herein), the metering check valve 210 may reopen and fluid may continue to move through the metering check valve 210, as previously disclosed herein, thereby allowing the sliding sleeve 126 to continue to move in the direction of the second position.

In an embodiment, following the transitioning of the sliding sleeve 126 into the second position, fluid may be allowed to escape the axial flowbore 115 of the casing 150 and the axial flowbore 124 of the IPTV 100 via the ports 122 of the IPTV 100.

In an embodiment, communicating a fluid via the IPTV 100 may comprise communicating a wellbore servicing fluid through the ports 122, for example, for the purposes of performing a formation stimulation operation. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 102 and/or a zone thereof.

Additionally or alternatively, in an embodiment, communicating a fluid via the IPTV 100 may comprise allowing fluid to escape from the casing string 150, for example, so as to allow an obturating member to be introduced within the casing string 150 and communicated therethrough (e.g., via forward fluid flow through the casing and out of the opened portion of the IPTV 100. For example, following a pressure test, an obturating member may be communicated through at least a portion of the casing string 150 so as to engage a suitable obturating member retainer (e.g., a seat) within a wellbore servicing tool incorporated within the casing string 150, for example, thereby allowing actuation of such a wellbore servicing tool (e.g., opening of one or more ports, sliding sleeves, windows, etc., within a fracturing and/or perforating tool) for the performance of a formation servicing operation, for example, a formation stimulation operation, such as a fracturing, perforating, acidizing, or like stimulation operation.

In an embodiment, a wellbore servicing operation may further comprise communicating a wellbore servicing fluid, for example, for the purposes of performing a formation stimulation operation via one or more wellbore servicing tools incorporated within the casing string. Additionally or alternatively, in an embodiment, the wellbore servicing method may further comprise producing a formation fluid (for example, a hydrocarbon, such as oil and/or gas) from the subterranean formation 102 via the wellbore 114.

In an embodiment, an IPTV 100, a system comprising an IPTV 100, and/or a wellbore servicing method employing such a system and/or an IPTV 100, as disclosed herein or in some portion thereof, may be advantageously employed in pressure testing a casing string. For example, in an embodiment, an IPTV like IPTV 100 enables a pressure testing of a casing string 150 to be halted (e.g., allowing the applied pressure to be reduced to inspect and/or repair the casing string 150) and later resumed (e.g., increasing the applied pressure following inspection and/or repairs). Conventional methods do not allow a pressure test to be resumed.

Additionally, in an embodiment, an IPTV like IPTV 100 enables a casing string to be safely pressurized (e.g., tested) at a desired pressure, but does not require that such test pressure be exceeded following the pressure test in order to transition open a valve. For example, because IPTV 100 can be configured to transitioned from the first configuration to the second configuration, as disclosed herein, upon any suitable pressure and because the IPTV 100 does not allow fluid communication until the IPTV 100 has maintained the suitable pressure for a predetermined duration of time, a IPTV as disclosed herein may be opened without exceeding the maximum value of the pressure test, for example, as is conventionally necessary.

As may be appreciated by one of skill in the art, conventional methods of providing fluid communication from the casing to the surrounding wellbore and/or formation following a pressure testing a casing string require, following the pressure test, over-pressuring a casing string to shear one or more shear pins and shift a sleeve or otherwise open fluid ports for fluid flow and thereby enable fluid communication from the axial flowbore of the casing string to the wellbore formation. As such, conventional tools, systems, and/or methods do not provide a way to ensure the opening of one or more ports without the use of pressure levels which would generally exceed the maximal pressures used during pressure testing. Therefore, the methods disclosed herein provide a means by which pressure testing of a casing string can be performed only requiring pressure levels within the standard pressure testing levels.

Additional Disclosure

The following are nonlimiting, specific embodiments in accordance with the present disclosure:

A first embodiment, which is a wellbore servicing system comprising:

a casing string; and a pressure testing valve, the pressure testing valve incorporated within the casing string and comprising:

a housing comprising one or more ports and an axial flowbore;

a sliding sleeve, wherein the sliding sleeve is slidably positioned within the housing and transitional from:

a first position to a second position through a sliding sleeve stroke;

wherein, when the sliding sleeve is in the first position, the sliding sleeve blocks a route of fluid communication via the one or more ports and, when the sliding sleeve is in the second position the sliding sleeve does not block the route of fluid communication via the one or more ports;

wherein the pressure testing valve is configured such that application of a predetermined pressure to the axial flowbore for a predetermined duration causes the sliding sleeve to transition from the first position to the second position, wherein the predetermined duration is at least about one minute.

A second embodiment, which is the wellbore servicing system of the first embodiment, wherein the predetermined pressure comprises a pressure threshold.

A third embodiment, which is the wellbore servicing system of the second embodiment, wherein the predetermined pressure varies over the predetermined duration.

A fourth embodiment, which is the wellbore servicing system of one of the first through the third embodiments, wherein the pressure testing valve comprises one or more frangible members.

A fifth embodiment, which is the wellbore servicing system of the fourth embodiment, wherein the one or more frangible members are configured to restrain the sliding sleeve in the first position.

A sixth embodiment, which is the wellbore servicing system of one of the first through the fifth embodiments, where the pressure testing valve comprises a fluid chamber, wherein the fluid chamber is not fluidicly exposed to the axial flowbore.

A seventh embodiment, which is the wellbore servicing system of the sixth embodiment, wherein the sliding sleeve comprises a collar, wherein the collar is configured to divide the fluid chamber into a first chamber portion and a second chamber portion across at least a first portion of the sliding sleeve stroke.

An eighth embodiment, which is the wellbore servicing system of the seventh embodiment, wherein the collar comprises a check valve, wherein the check valve is configured to control fluid communication from the first chamber portion to the second chamber portion over at least the first portion of the sliding sleeve stroke.

A ninth embodiment, which is the wellbore servicing system of one of the second through the third embodiments, wherein the pressure threshold is at least about 8,000 p.s.i.

A tenth embodiment, which is the wellbore servicing system of one of the second through the third embodiments, wherein the pressure threshold is at least about 10,000 p.s.i.

An eleventh embodiment, which is the wellbore servicing system of the third embodiment, wherein the predetermined duration is from about 15 minutes to about 60 minutes.

A twelfth embodiment, which is the wellbore servicing system of the third embodiment, wherein the predetermined duration comprises an accumulation of one or more subintervals of time.

A thirteenth embodiment, which is a wellbore servicing method comprising:

positioning casing string having a pressure testing valve incorporated therein within a wellbore penetrating the subterranean formation, wherein the pressure testing valve comprises:

a housing comprising one or more ports and an axial flowbore; and a sliding sleeve, wherein the sliding sleeve is slidably positioned within the housing, wherein the sliding sleeve is configured to block a route of fluid communication via one or more ports when the casing string is positioned within the wellbore;

applying a fluid pressure of at least a pressure threshold to the axial flowbore, wherein, upon application of the fluid pressure of at least the pressure threshold, the sliding sleeve continues to block the route of fluid communication via the one or more ports; and continuing to apply fluid pressure to the axial flowbore for a predetermined duration of time, wherein the predetermined duration is at least about one minute, and wherein, following the predetermined duration of time, the sliding sleeve allows fluid communication via one or more ports of the housing.

A fourteenth embodiment, which is the method of the thirteenth embodiment, wherein the sliding sleeve is initially retained by one or more frangible members prior to the application of fluid pressure of at least the upper threshold, wherein the application of fluid pressure of at least the pressure threshold causes the one or more frangible members to fail.

A fifteenth embodiment, which is the method of one of the thirteenth through the fourteenth embodiments, wherein the pressure threshold is at least about 8,000 p.s.i.

A sixteenth embodiment, which is the method of one of the thirteenth through the fifteenth embodiments, wherein the pressure threshold is at least about 10,000 p.s.i.

A seventeenth embodiment, which is the method of one of the thirteenth through the sixteenth embodiments, wherein the predetermined duration is from about 15 minutes to about 60 minutes.

An eighteenth embodiment, which is the method of one of the thirteenth through the seventeenth embodiments, further comprising communicating a fluid via the one or more ports.

A nineteenth embodiment, which is a wellbore servicing method comprising:

positioning a casing string having a pressure testing valve incorporated therein within a wellbore penetrating a subterranean formation;

pressurizing an axial flowbore of the casing string for a predetermined duration, wherein the pressure within the axial flowbore reaches at least a pressure threshold, wherein, upon pressurizing the axial flowbore for the predetermined duration, the pressure testing valve opens, and wherein a pressure substantially exceeding the pressure threshold is not applied to the casing string to open the pressure testing valve.

A twentieth embodiment, which is a wellbore servicing method comprising:

pressure testing at a first pressure a tubing string positioned within a wellbore penetrating a subterranean formation, wherein the pressure test comprises an application of pressure for a predetermined duration, wherein during at least a portion of the predetermined duration, the application of pressure is of at least a pressure threshold, and wherein a pressure substantially exceeding the pressure threshold is not applied to the casing string during the pressure test;

following the predetermined duration, flowing a fluid down the tubing string and into the wellbore or the subterranean formation.

A twenty-first embodiment, which is the method of the twentieth embodiment, wherein flowing the fluid down the tubing string further comprises flowing an obturating member down the tubing string, landing the obturating member on a landing structure associated with a wellbore tool, and applying a hydraulic force to the wellbore tool via the landed obturating member to configure the wellbore tool to perform a wellbore service.

A twenty-second embodiment, which is the method of one of the twentieth through the twenty-first embodiments, wherein the obturating member is a ball or dart, the landing structure is a seat configured to receive the ball or dart, the wellbore servicing tool is a fracturing or perforating tool, and the wellbore service is a fracturing or perforating service.

A twenty-third embodiment, which is the method of one of the twentieth through the twenty-second embodiments, wherein flowing the fluid down the tubing string further comprises communicating a wellbore servicing fluid at a rate and/or pressure sufficient to initiate and/or extend a fluid pathway with the formation.

A twenty-fourth embodiment, which is a pressure testing valve comprising:

a housing comprising one or more ports;

a sliding sleeve, slidably positioned within the housing and movable from a first position with respect to the housing to a second position with respect to the housing, wherein, in the first position, the sliding sleeve blocks a route of fluid communication via the one or more port, and wherein, in the second position, the sliding sleeve does not block the route of fluid communication via the ports; and a fluid delay system, wherein the fluid delay system is generally configured to control the movement of the sliding sleeve from the first position to the second position.

A twenty-fifth embodiment, which is the pressure testing valve of the twenty-fourth embodiment, wherein the fluid delay system comprises:

a first chamber;

a second chamber; and a metering check valve, wherein the metering check valve is configured to control passage of a fluid from the second chamber to the first chamber.

A twenty-sixth embodiment, which is the pressure testing valve of the twenty-fifth embodiment, wherein the metering check valve is configured to allow fluid movement from the second chamber to the first chamber and to not allow fluid communication from the first chamber to the second chamber.

A twenty-seventh embodiment, which is the pressure testing valve of one of the twenty-fifth through the twenty sixth embodiments, wherein the metering check valve is generally disposed within a collar extending circumferentially around the sliding sleeve.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing system comprising:

a casing string; and a pressure testing valve, the pressure testing valve incorporated within the casing string and comprising:

a housing comprising one or more ports and an axial flowbore;

a fluid chamber not fluidicly exposed to the axial flowbore;

a sliding sleeve, wherein the sliding sleeve is slidably positioned within the housing and transitional from:

a first position to a second position through a sliding sleeve stroke;

wherein, when the sliding sleeve is in the first position, the sliding sleeve blocks a route of fluid communication via the one or more ports and, when the sliding sleeve is in the second position the sliding sleeve does not block the route of fluid communication via the one or more ports;

wherein the pressure testing valve is configured such that application of a predetermined pressure to the axial flowbore for a predetermined duration causes the sliding sleeve to transition from the first position to the second position, wherein the predetermined duration is at least about one minute;

the sliding sleeve comprises a collar configured to divide the fluid chamber into a first chamber portion and a second chamber portion across at least a first portion of the sliding sleeve stroke; and the collar comprises a check valve configured to control fluid communication from the first chamber portion to the second chamber portion over at least the first portion of the sliding sleeve stroke.

2. The wellbore servicing system of claim 1, wherein the predetermined pressure comprises a pressure threshold.

3. The wellbore servicing system of claim 2, wherein the predetermined pressure varies over the predetermined duration.

4. The wellbore servicing system of claim 1, wherein the pressure testing valve comprises one or more frangible members.

5. The wellbore servicing system of claim 4, wherein the one or more frangible members are configured to restrain the sliding sleeve in the first position.

6. The wellbore servicing system of claim 2, wherein the pressure threshold is at least about 8,000 p.s.i.

7. The wellbore servicing system of claim 2, wherein the pressure threshold is at least about 10,000 p.s.i.

8. The wellbore servicing system of claim 3, wherein the predetermined duration is from about 15 minutes to about 60 minutes.

9. The wellbore servicing system of claim 3, wherein the predetermined duration comprises an accumulation of one or more subintervals of time.

10. A wellbore servicing method comprising:

positioning casing string having a pressure testing valve incorporated therein within a wellbore penetrating the subterranean formation, wherein the pressure testing valve comprises:

a housing comprising one or more ports and an axial flowbore;

a fluid chamber not fluidicly exposed to the axial flowbore; and a sliding sleeve, wherein the sliding sleeve is slidably positioned within the housing;

the sliding sleeve is configured to block a route of fluid communication via one or more ports when the casing string is positioned within the wellbore;

the sliding sleeve comprises a collar configured to divide the fluid chamber into a first chamber portion and a second chamber portion across at least a first portion of the sliding sleeve stroke; and the collar comprises a check valve configured to control fluid communication from the first chamber portion to the second chamber portion over at least the first portion of the sliding sleeve stroke;

applying a fluid pressure of at least a pressure threshold to the axial flowbore, wherein, upon application of the fluid pressure of at least the pressure threshold, the sliding sleeve continues to block the route of fluid communication via the one or more ports; and continuing to apply fluid pressure to the axial flowbore for a predetermined duration of time, wherein the predetermined duration is at least about one minute, and wherein, following the predetermined duration of time, the sliding sleeve allows fluid communication via one or more ports of the housing.

11. The method of claim 10, wherein the sliding sleeve is initially retained by one or more frangible members prior to the application of fluid pressure of at least the upper threshold, wherein the application of fluid pressure of at least the pressure threshold causes the one or more frangible members to fail.

12. The method of claim 10, wherein the pressure threshold is at least about 8,000 p.s.i.

13. The method of claim 10, wherein the pressure threshold is at least about 10,000 p.s.i.

14. The method of claim 10, wherein the predetermined duration is from about 15 minutes to about 60 minutes.

15. The method of claim 10, further comprising communicating a fluid via the one or more ports.

* * * * *